US007553143B2

(12) United States Patent
Yang et al.

(10) Patent No.: US 7,553,143 B2
(45) Date of Patent: Jun. 30, 2009

(54) LOBE PUMP SYSTEM AND METHOD OF MANUFACTURE

(75) Inventors: Daniel C. H. Yang, Santa Monica, CA (US); Shih-Hsi Tong, San Gabriel, CA (US)

(73) Assignee: The Regents of the University of California, Oakland, CA (US)

( * ) Notice: Subject to any disclaimer, the term of this patent is extended or adjusted under 35 U.S.C. 154(b) by 17 days.

(21) Appl. No.: 11/110,019

(22) Filed: Apr. 19, 2005

(65) Prior Publication Data

US 2005/0257371 A1 Nov. 24, 2005

Related U.S. Application Data

(60) Provisional application No. 60/563,436, filed on Apr. 19, 2004.

(51) Int. Cl.
*F04C 18/12* (2006.01)

(52) U.S. Cl. ..... 418/150; 29/888.02; 29/889.23

(58) Field of Classification Search ..... 418/150, 418/166; 29/888.02, 889.23
See application file for complete search history.

(56) References Cited

U.S. PATENT DOCUMENTS 2,897,765 A * 8/1959 Kitano ..... 418/206.5
3,327,637 A * 6/1967 Hotta ..... 418/150
3,371,856 A * 3/1968 Thelen et al. ..... 418/150
4,145,168 A * 3/1979 Smith et al. ..... 418/150
4,224,015 A * 9/1980 Nagata ..... 418/150
4,511,316 A * 4/1985 Ellis ..... 418/150
4,666,384 A * 5/1987 Kaga et al. ..... 418/150
4,974,318 A * 12/1990 Heppekausen et al. . 29/888.023
5,040,959 A * 8/1991 Fukagawa ..... 418/150
5,152,684 A * 10/1992 Steffens ..... 418/150
5,336,069 A * 8/1994 Matsuyama ..... 418/206.5
5,638,600 A * 6/1997 Rao et al. ..... 29/888.02
6,644,947 B2 * 11/2003 Cavanaugh ..... 418/206.5

OTHER PUBLICATIONS

Daniel C. H. Yang and Shih-His Tong, "The specific flowrate of deviation function based lobe pumps—derivation and analysis", Oct. 2002, Mechanism and Machine Theory, vol. 37, Issue 10, pp. 1025-1042.*

(Continued)

*Primary Examiner*—Thomas E Denion
*Assistant Examiner*—Mary A Davis
(74) *Attorney, Agent, or Firm*—Christie, Parker & Hale, LLP

(57) ABSTRACT

A method of manufacturing a rotor to be used in a dual-rotor lobe pump system for pumping a material at a periodic rate is provided. The method includes selecting a desired periodic flow rate for the material, selecting a number of lobes for the rotor, and selecting either a thickness of the rotor or a spacing between the dual-rotors' axes of rotation in the lobe pump. The method also includes determining the profile for the rotor based on the desired periodic flow rate, so that when the rotor is operated within the dual-rotor lobe pump system, the material can be pumped at substantially the desired periodic flow rate. In another embodiment of the invention, a lobe pump rotor profile is formed by the method described above.

15 Claims, 15 Drawing Sheets

OTHER PUBLICATIONS

G. Mimmi and P. Pennachhi, "Flow Rate Regularity in Rotary Trochoidal-Lobe Pumps", 1994, ASME Machine Elements and Machine Dynamics, DE-vol. 71, pp. 295-302.*

S. H. Tong, 1998, "New Conjugate Pair Design-Theory and Application", Ph.D. Dissertation, Mechanical and Aerospace Engineering Department, UCLA, pp. 7-78, 106-111, 119-127, 135-137.*

S. H. Tong and D. C. H. Yang, "Lobe Pumps that Deliver Your Desired Flowrate Functions", Apr. 8, 2004, Research and Technology Review—Department of Mechanical and Aerospace Engineering at University of California, Los Angeles, MAE Abstract, p. 1.*

S. H. Tong and D. C. H. Yang, "On the generation of new lobe pumps for higher pumping flowrate", 2000, Mechanism and Machine Theory, vol. 35, Issue 7, pp. 997-1012.*

T. Costopoulos, A. Kanarachos, and E. Pantzis, "Reduction of Delivery Fluctuation and Optimum Tooth Profile of Spur Gear Rotary Pumps", 1988, Mechanism and Machine Theory, vol. 23, No. 2, pp. 141-146.*

Iyoi et al., "Formulae to Obtain Capacity and Effective Work of Positive Displacement Pumps and Their Applications to the Design of Tooth Contours", Trans. JSME, Nov. 1963, vol. 29, No. 207, pp. 1778-1785 (English translation provided).*

Bidhendi, I. M., Et al., "Computer Predictions of Cyclic Excitation Sources for an External Gear Pump," Computer Aided Design in High Pressure Hydraulic Systems, Mechanical Engineering Publications, London, 1983, pp. 23-29.

Dillon, M. L. et al., "Predicting Flowrates from Positive Displacement Rotary Pumps", Chemical Engineering (New York), N. 15, vol. 82, 1985, pp. 57-60.

Liu, Hung-Cheng et al., "Trapping-Free Rotors for High Sealing Lobe Pumps", Trans. ASME Journal of Mechanical Design, vol. 122, No. 4, 2000, pp. 536-542.

Mimmi, G., "Experimental Investigation of Flow Rate Irregularity in Rotary Gear Pumps," Proceedings, VI ASME International Power Transmission and Gearing Conference, 1992, Scottsdale AZ., pp. 283-289.

Tong, S.H. et al., "Generation of Identical Noncircular Pitch Curves", ASME Journal of Mechanical Design, vol. 120, No. 2, 1998, pp. 337-341.

Yang, D. C. et al., "Deviation-Function Based Pitch Curve Modification For Conjugate Pair Design", ASME Journal of Mechanical Design, 1999, vol. 121, No. 4, pp. 579-586.

Dickenson, T.C., "Pumping Manual", 9th Elsevier Science, Ltd. 1995, pp. 243-280.

* cited by examiner

Select $F_{max}$, $F_{min}$, T, $l$, N, and function type $f(\theta)$

Apply boundary conditions to determine $F(\theta)$

Calculate half lobe profile according to:

$$g_x = \frac{l}{2}\cos\theta + \frac{l}{F_{min}}\sqrt{(F_{max}-F_{min})(F_{max}-F(\theta))}\cos\left(\theta + \sin^{-1}\left(\frac{-F'(\theta)\sqrt{F_{max}-F_{min}}}{F_{min}\sqrt{F_{max}-F(\theta)}}\right)+\pi\right)$$

$$g_y = \frac{l}{2}\sin\theta + \frac{l}{F_{min}}\sqrt{(F_{max}-F_{min})(F_{max}-F(\theta))}\sin\left(\theta + \sin^{-1}\left(\frac{-F'(\theta)\sqrt{F_{max}-F_{min}}}{F_{min}\sqrt{F_{max}-F(\theta)}}\right)+\pi\right)$$

for $0 \le \theta \le \frac{\pi}{2N}$, where $F'(\theta) = \frac{dF(\theta)}{d\theta}$; and $$g_x = \frac{l}{2}\cos\theta + \frac{l}{F_{min}}\sqrt{(F_{max}-F_{min})(F_{max}-F(\theta))}\cos\left(\theta - \sin^{-1}\left(\frac{-F'(\theta)\sqrt{F_{max}-F_{min}}}{F_{min}\sqrt{F_{max}-F(\theta)}}\right)\right)$$

$$g_y = \frac{l}{2}\sin\theta + \frac{l}{F_{min}}\sqrt{(F_{max}-F_{min})(F_{max}-F(\theta))}\sin\left(\theta - \sin^{-1}\left(\frac{-F'(\theta)\sqrt{F_{max}-F_{min}}}{F_{min}\sqrt{F_{max}-F(\theta)}}\right)\right)$$

for $\frac{\pi}{2N} \le \theta \le \frac{\pi}{N}$.

Determine other half lobe profile symmetric to calculated half

Form rest of N lobes with same lobe profile and spaced equal distant from the other lobes

Figure 6

Select F(t), N, and $l$

Calculate half lobe profile according to:

$$g_x = \frac{l}{2}\cos\frac{\pi \cdot t}{TN} + \frac{l}{F_{\min}}\sqrt{(F_{\max}-F_{\min})(F_{\max}-F(t))}\cos\left(\frac{\pi \cdot t}{TN} + \sin^{-1}\left(\frac{-TNF'(t)\sqrt{F_{\max}-F_{\min}}}{\pi \cdot F_{\min}\sqrt{F_{\max}-F(t)}}\right) + \pi\right)$$

$$g_y = \frac{l}{2}\sin\frac{\pi \cdot t}{TN} + \frac{l}{F_{\min}}\sqrt{(F_{\max}-F_{\min})(F_{\max}-F(t))}\sin\left(\frac{\pi \cdot t}{TN} + \sin^{-1}\left(\frac{-TNF'(t)\sqrt{F_{\max}-F_{\min}}}{\pi \cdot F_{\min}\sqrt{F_{\max}-F(t)}}\right) + \pi\right)$$

for $0 \le t \le \frac{T}{2}$, where $F'(t) = \frac{dF(t)}{dt}$; and $$g_x = \frac{l}{2}\cos\frac{\pi \cdot t}{TN} + \frac{l}{F_{\min}}\sqrt{(F_{\max}-F_{\min})(F_{\max}-F(t))}\cos\left(\frac{\pi \cdot t}{TN} - \sin^{-1}\left(\frac{-TNF'(t)\sqrt{F_{\max}-F_{\min}}}{\pi \cdot F_{\min}\sqrt{F_{\max}-F(t)}}\right)\right)$$

$$g_y = \frac{l}{2}\sin\frac{\pi \cdot t}{TN} + \frac{l}{F_{\min}}\sqrt{(F_{\max}-F_{\min})(F_{\max}-F(t))}\sin\left(\frac{\pi \cdot t}{TN} - \sin^{-1}\left(\frac{-TNF'(t)\sqrt{F_{\max}-F_{\min}}}{\pi \cdot F_{\min}\sqrt{F_{\max}-F(t)}}\right)\right)$$

for $\frac{T}{2} \le t \le T$.

Determine other half lobe profile symmetric to calculated half

Form rest of N lobes with same lobe profile and spaced equal distant from the other lobes

Figure 11

Select F(θ), N, and $l$

Calculate half lobe profile according to:

$$g_x = \frac{l}{2}\cos\theta + \frac{l}{F_{\min}}\sqrt{(F_{\max}-F_{\min})(F_{\max}-F(\theta))}\cos\left(\theta + \sin^{-1}\left(\frac{-F'(\theta)\sqrt{F_{\max}-F_{\min}}}{F_{\min}\sqrt{F_{\max}-F(\theta)}}\right)+\pi\right)$$

$$g_y = \frac{l}{2}\sin\theta + \frac{l}{F_{\min}}\sqrt{(F_{\max}-F_{\min})(F_{\max}-F(\theta))}\sin\left(\theta + \sin^{-1}\left(\frac{-F'(\theta)\sqrt{F_{\max}-F_{\min}}}{F_{\min}\sqrt{F_{\max}-F(\theta)}}\right)+\pi\right)$$

for $0 \le \theta \le \frac{\pi}{2N}$, where $F'(\theta) = \frac{dF(\theta)}{d\theta}$; and $$g_x = \frac{l}{2}\cos\theta + \frac{l}{F_{\min}}\sqrt{(F_{\max}-F_{\min})(F_{\max}-F(\theta))}\cos\left(\theta - \sin^{-1}\left(\frac{-F'(\theta)\sqrt{F_{\max}-F_{\min}}}{F_{\min}\sqrt{F_{\max}-F(\theta)}}\right)\right)$$

$$g_y = \frac{l}{2}\sin\theta + \frac{l}{F_{\min}}\sqrt{(F_{\max}-F_{\min})(F_{\max}-F(\theta))}\sin\left(\theta - \sin^{-1}\left(\frac{-F'(\theta)\sqrt{F_{\max}-F_{\min}}}{F_{\min}\sqrt{F_{\max}-F(\theta)}}\right)\right)$$

for $\frac{\pi}{2N} \le \theta \le \frac{\pi}{N}$.

Determine other half lobe profile symmetric to calculated half

Form rest of N lobes with same lobe profile and spaced equal distant from the other lobes

Figure 12

LOBE PUMP SYSTEM AND METHOD OF MANUFACTURE

CROSS-REFERENCE TO RELATED APPLICATION

This application claims the benefit of Provisional Application Ser. No. 60/563,436, filed Apr. 19, 2004, entitled FLOW-RATE SYNTHESIS OF LOBE PUMPS, the entire disclosure of which is incorporated herein by reference.

STATEMENT REGARDING FEDERALLY SPONSORED RESEARCH OR DEVELOPMENT

The United States government has certain rights in this invention pursuant to Grant No. CMS-9812847, awarded by the National Science Foundation.

BACKGROUND OF THE INVENTION

Positive displacement rotary pumps, known as "lobe pumps," are widely used in industries such as pulp and paper, chemical, equipment, food, beverage, pharmaceutical, and biotechnology. Lobe pumps can pump a wide variety of materials at continuous or intermittent flows.

A standard three-lobe pump is shown in FIGS. 1A-1C. Two identical rotors 10, 12 rotate in opposite directions around their respective axes of rotation 14, 16 to mesh as shown. The axes of rotation 14, 16 are separated by a distance l.

Each rotor has multiple lobes 20. The lobes of each of the rotors 10, 12 come in close proximity to the other rotor and to the interior of the lobe pump casing 30, so that material 40 can be trapped between the lobes 20 of the rotors 10, 12 and the pump casing 30.

As the rotors rotate within the lobe pump casing 30, material 40 flows into an inlet end 32 of the casing 30 (FIG. 1A), is subsequently trapped between the lobe 20 of a rotor 10 and the casing 30 (FIG. 1B), and then is pushed out of the pump through the outlet end 34 (FIG. 1C). As the lobes rotate, the material 40 travels around the outside of the rotors 10, 12.

The rotors of a standard lobe pump can be rotated by a driving gear 52 and a driven gear 50, as shown in FIG. 2A. As shown, the rotors 10', 12' can each have two lobes 20' instead of the three shown in FIGS. 1A-1C, or rotors can alternatively be designed to have any number of lobes. The rotor frequency n is the same as the frequency of its driving motor, and is related to a pumping period T by the following expression:

$$n = \frac{1}{2NT},$$

where N is the number of lobes on each rotor.

Profiles for the rotors within a lobe pump can be designed using the "deviation function method." See, e.g., Yang, Tong, and Lin, "Deviation-Function Based Pitch Curve Modification for Conjugate Pair Design," J. of Mech. Des. v. 121, pp. 579-586 (1999), the entire contents of which are incorporated herein by reference. This method uses a function that describes the deviation of the conjugate pair (or rotor pair) from the profile of a pitch pair, such as a pair of ellipses or circles rotating in opposite directions while maintaining contact. This method allows one skilled in the art to generate a profile of a conjugate pair with a desired geometry so that it matches the rotation of a given pitch pair. For example, the deviation function method could generate a rotor profile with a desired number of lobes of a desired length and noncircularity, etc., that rotates with another rotor similarly to a pair of oppositely rotating circles. This reference allows a broad range of rotor profiles to be generated that correspond to given pitch pairs, but suggests no particular geometry for the rotor or the effects of such geometry.

There are typically two types of lobe pumps used in the industry: conventional, involute lobe pumps and epitrochoidal lobe pumps. FIG. 3A shows a profile of a conventional involute lobe pump rotor. Involute lobe pump rotors have a smooth, continuous profile.

Epitrochoidal lobe pumps have rotors with profiles composed of circular arcs and epitrochoidal curves that do not have first order continuity at some intersections of curve segments. An example of lobe profiles of epitrochoidal rotors is shown in FIG. 4.

Resultant flow rates of conventional lobe pump systems or systems with rotor profiles generated through the deviation function method, described above, have also been previously described by Applicants in "The specific flowrate of deviation function based lobe pumps—derivation and analysis," Mechanism and Machine Theory 37, pp. 1025-1042 (2002), the entire contents of which are incorporated herein by reference.

In this reference, a normalized flow rate can be derived from a given profile that deviates from an non-circular or circular pitch profile according to a given deviation function, e(θ). Specifically, a flow rate in terms of an angle of rotation θ of the rotor can be expressed as:

$$F(\theta) = \frac{\dot{\theta} \cdot l(b^2 - r(l-r) - e(\theta)^2)w}{2(l-r)},$$

where, referring to FIGS. 2B-C, l represents the distance between the rotors' axes of rotation 140, 160, w is the rotor thickness, b is the lobe length, r is the distance from the axis of rotation 160 of the rotor 120 to a contact point P. The contact point P is the point of contact of the rotors' 140, 160 respective pitch profiles $p_1$, $p_2$. e(θ) is the deviation function, or a function showing the deviation of the profile of the actual rotor 120 from its corresponding pitch profile $p_1$.

It is known that a flow rate of material out of a conventional, involute lobe pump will be a periodic, parabolic function of the angular position θ of the pump rotors, as shown in FIG. 3B. See, Mimmi, 1992; Mimmi and Pennacchi, 1994. The amplitude variation of the periodic function is due to the change of the contact point position of the rotors during the meshing. These periodic functions are described in more detail in, e.g., Yang and Tong, 2000; Bidhendi et al., 1983; and Iyoi and Togashi, 1963. It is also known that the flow rate of material out of epitrochoidal lobe pumps is constant. See Mimmi and Pennacchi, 1994.

One problem present with both existing conventional lobe pump systems is that a user is limited to either a specific constant or a specific periodic parabola flow rate, depending on the type of conventional rotor the user chooses. If a particular periodic flow rate is required for an application, such as a volume of flow that varies sinusoidally with time or angle of rotation, neither of the conventional lobe pump types would be sufficient. Further, even if a periodic parabola or constant type flow rate is required, a user is currently limited to a small number of standard lobe profiles from which to choose. Thus, a user would likely need to employ an entirely different, and costlier, type of pump to achieve a desired flow rate.

SUMMARY OF THE INVENTION

The instant invention is directed to a method of generating lobe pump rotor profiles based on a desired resultant flow rate. One embodiment of the invention provides a method of manufacturing a rotor to be used in a dual-rotor lobe pump system for pumping a material at a periodic rate. The method includes selecting a desired periodic flow rate for the material, selecting a number of lobes for the rotor, and selecting either a thickness of the rotor or a spacing between the dual-rotors' axes of rotation in the lobe pump. The method also includes determining the profile for the rotor based on the desired periodic flow rate, so that when the rotor is operated within the dual-rotor lobe pump system, the material may be pumped at substantially the desired periodic flow rate. In another embodiment of the invention, a lobe pump rotor is formed by the method described above.

BRIEF DESCRIPTION OF THE DRAWINGS

These and other features and advantages of the invention will become better understood when considered in conjunction with the following detailed description and by referring to the appended drawings, wherein

FIG. 6 is a step diagram of a method according to another embodiment of the invention;

FIG. 11 is a step diagram of another embodiment of a method according to the invention; and FIG. 12 is a step diagram of yet another embodiment of a method according to the invention.

DETAILED DESCRIPTION

Figure 5:
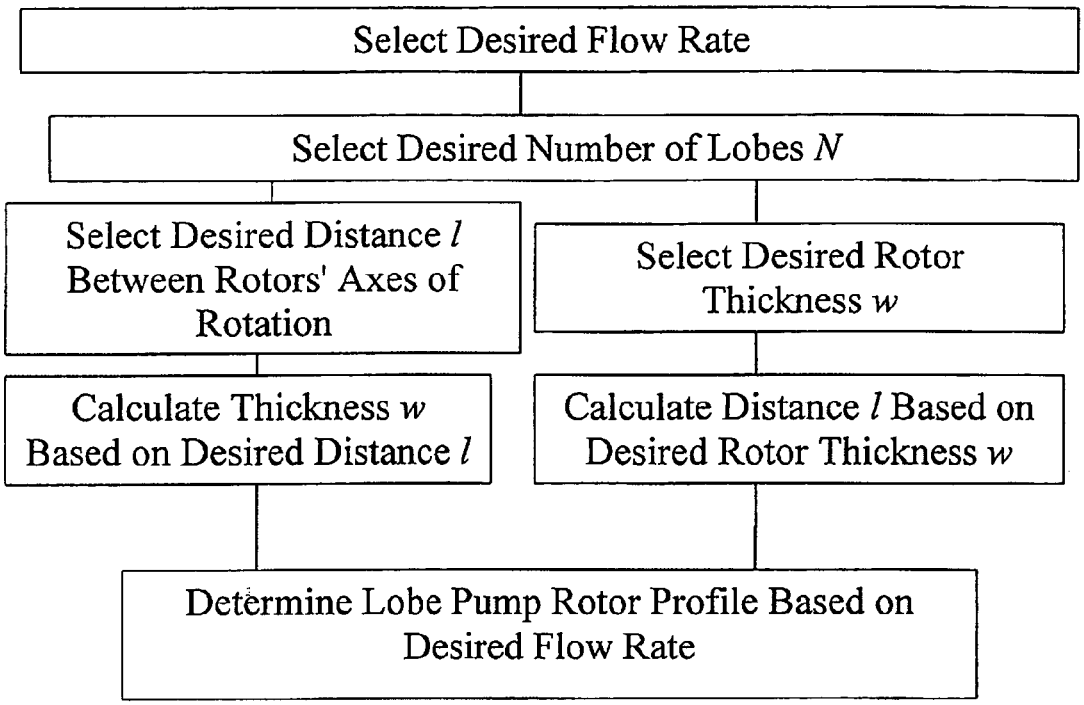
FIG. 5 is a step diagram of a method according to one embodiment of the invention.

The instant invention is directed to the design and manufacture of lobe pump profiles that will result in a desired flow rate of material. Referring to FIG. 5, a method for designing a profile includes selecting a desired periodic flow rate for the material. A user may have a particular flow rate function that is required for the application, or the user may merely need a particular maximum flow rate, minimum flow rate, function type (such as parabolic, sinusoidal, polynomial, linear, constant, etc.), and period. A flow rate function may be in many different forms, but the flow of material expressed either in terms of time t or the angle of a rotor's rotation θ will be addressed more specifically below.

A number of lobes for the rotor is then selected, along with a thickness of the rotor or a spacing between the dual rotors' axes of rotation in the lobe pump. The profile is then determined based on the desired periodic flow rate. The determination of the profile can be accomplished by reversing the deviation function method to begin with a desired periodic flow rate and ending with a rotor profile that accomplishes that flow rate.

With reference to FIGS. 2B-3A and 6, another embodiment of the method is described. In this embodiment, the desired flow rate is expressed as a maximum flow rate $F_{max}$, a minimum flow rate $F_{min}$, a function type with some unknown variables F(θ), and a period T. The number of lobes on each rotor is selected to be N, and the distance between the two rotors' axes of rotation is selected to be l.

The function F(θ) of the actual, non-normalized desired flow rate in terms of the angle of rotation θ of the rotor 120 is then generated through known methods using boundary conditions of $F(0)=F_{min}$, $F(\phi)=F_{max}$, and $$\left.\frac{dF(\theta)}{d\theta}\right|_{\phi}=0,$$

where ϕ is the angle θ where the pitch profile intersects the generated rotor profile. For circular pitch profiles p, such as that shown in FIG. 3A, $$\phi=\frac{\pi}{2N}.$$

With this function F(θ), and the selected $F_{max}$, $F_{min}$, T, l, and N, half of one lobe profile g is designed according to the following two equations:

$$g_x=\frac{l}{2}\cos\theta+\frac{l}{F_{\min}}\sqrt{(F_{\max}-F_{\min})(F_{\max}-F(\theta))}\cos\left(\theta+\sin^{-1}\left(\frac{-F'(\theta)\sqrt{F_{\max}-F_{\min}}}{F_{\min}\sqrt{F_{\max}-F(\theta)}}\right)+\pi\right) \quad 1)$$

$$g_y=\frac{l}{2}\sin\theta+\frac{l}{F_{\min}}\sqrt{(F_{\max}-F_{\min})(F_{\max}-F(\theta))}\sin\left(\theta+\sin^{-1}\left(\frac{-F'(\theta)\sqrt{F_{\max}-F_{\min}}}{F_{\min}\sqrt{F_{\max}-F(\theta)}}\right)+\pi\right)\text{ for }0\le\theta\le\frac{\pi}{2N},\text{ where }F'(\theta)=\frac{dF(\theta)}{d\theta};\text{ and}$$

-continued $$g_x = \frac{l}{2}\cos\theta + \frac{l}{F_{\min}}\sqrt{(F_{\max}-F_{\min})(F_{\max}-F(\theta))}\cos\left(\theta - \sin^{-1}\left(\frac{-F'(\theta)\sqrt{F_{\max}-F_{\min}}}{F_{\min}\sqrt{F_{\max}-F(\theta)}}\right)\right) \quad 2)$$

$$g_y = \frac{l}{2}\sin\theta + \frac{l}{F_{\min}}\sqrt{(F_{\max}-F_{\min})(F_{\max}-F(\theta))}\sin\left(\theta - \sin^{-1}\left(\frac{-F'(\theta)\sqrt{F_{\max}-F_{\min}}}{F_{\min}\sqrt{F_{\max}-F(\theta)}}\right)\right) \text{ for } \frac{\pi}{2N} \le \theta \le \frac{\pi}{N}.$$

The other half of the lobe profile is then designed to be symmetric to the profile generated by the equations above. Identical lobes can then be designed for a total of N lobes per rotor, which are spaced equally from each other and projecting radially from the axis of rotation 160.

A thickness w of the rotor can be determined according to $$wl^2 = \frac{NTF_{\min}^2}{\pi(F_{\max}-F_{\min})}.$$

Alternatively, a desired thickness can be selected and the distance l can be determined through this same calculation. The distance l can then be used to calculate the half lobe profile, as above, and the other half of the lobe profile is then designed to be symmetric to the generated profile.

Figure 1C:
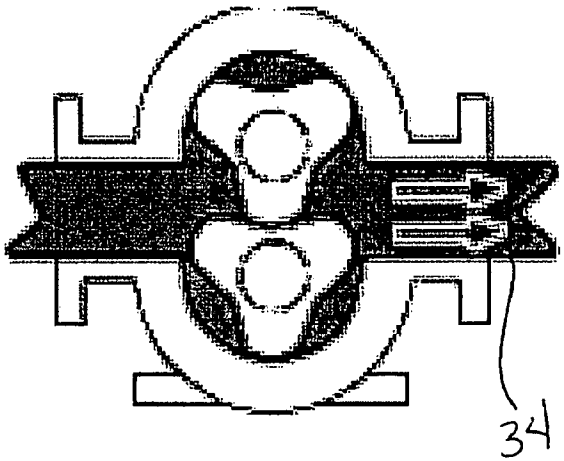
FIG. 1C is a cross section of the lobe pump shown in FIGS. 1A and 1B as the material begins to move out of the chamber.
Figure 1B:
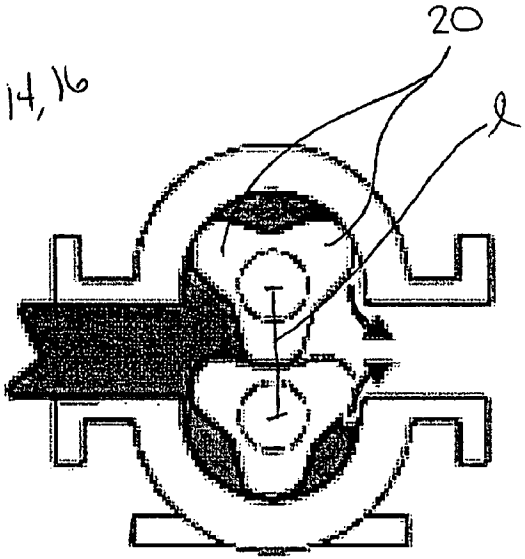
FIG. 1B is a cross section of the lobe pump shown in FIG. 1A as the material moves through the chamber.
Figure 1A:
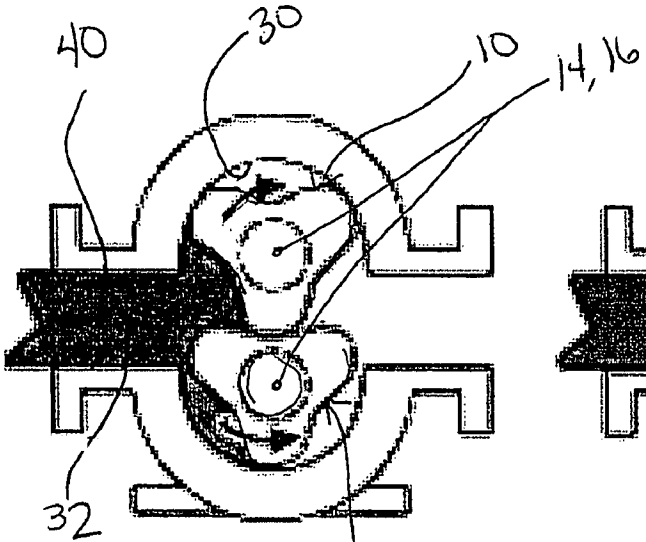
FIG. 1A is a cross section of a conventional lobe pump as material is entering the lobe pump chamber.
Figure 2A:
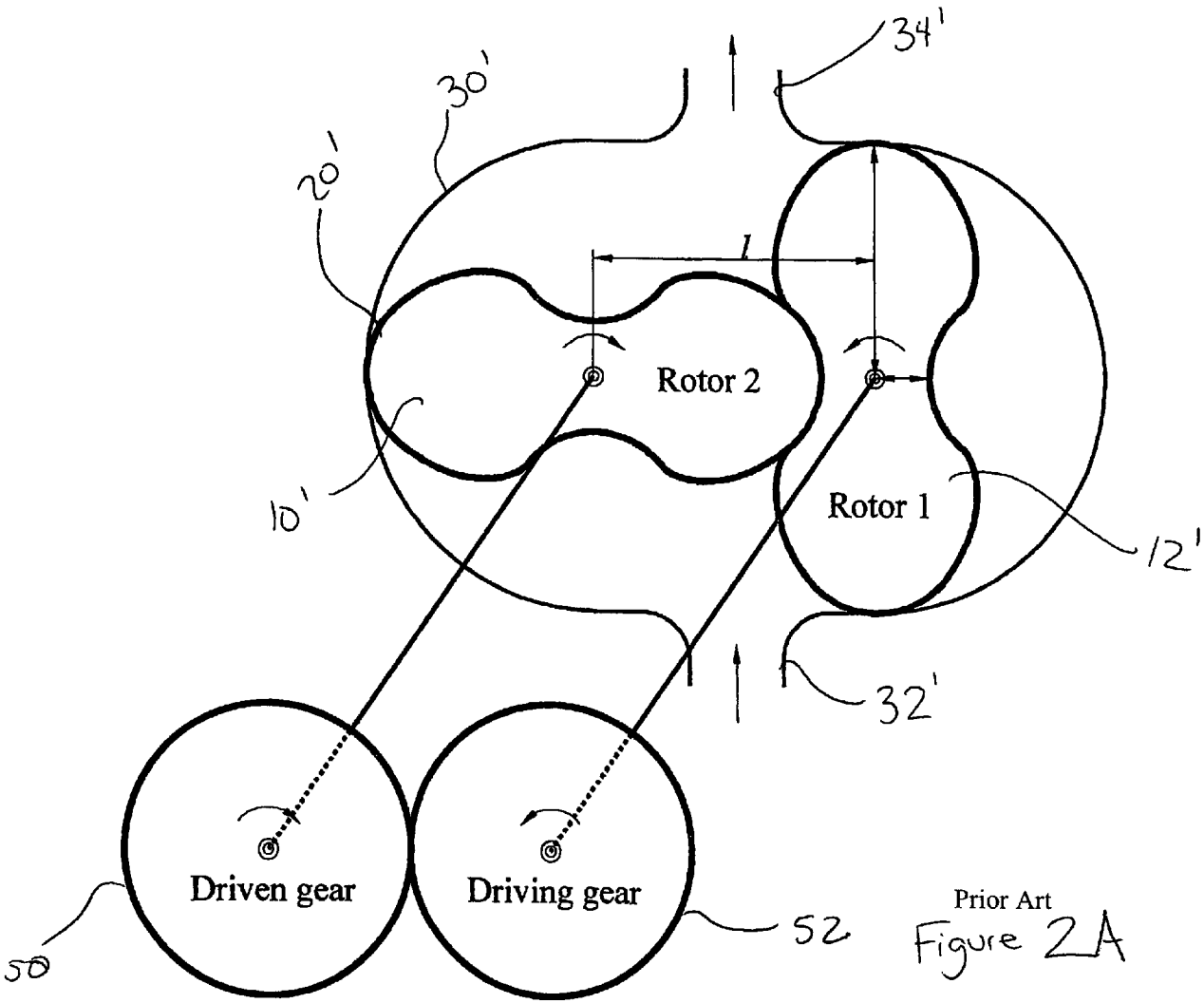
Prior Art Figure 2A
FIG. 2A is a diagram of a conventional lobe pump system.
Figure 2B:
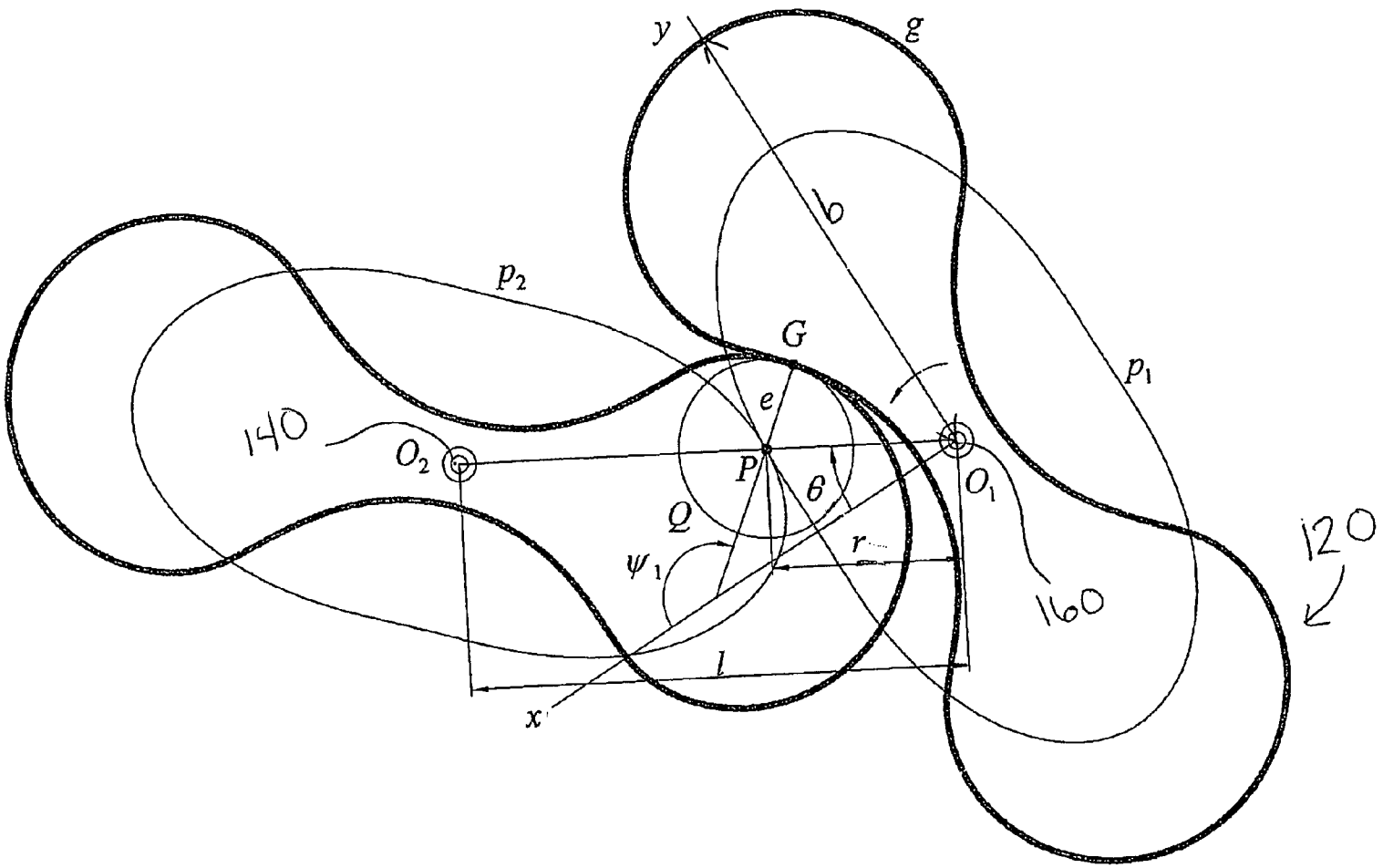
FIG. 2B is a detailed plan view of a pair of lobe pump rotor profiles, generated by the deviation function method, that correspond to non-circular pitch profiles.
Figure 2C:
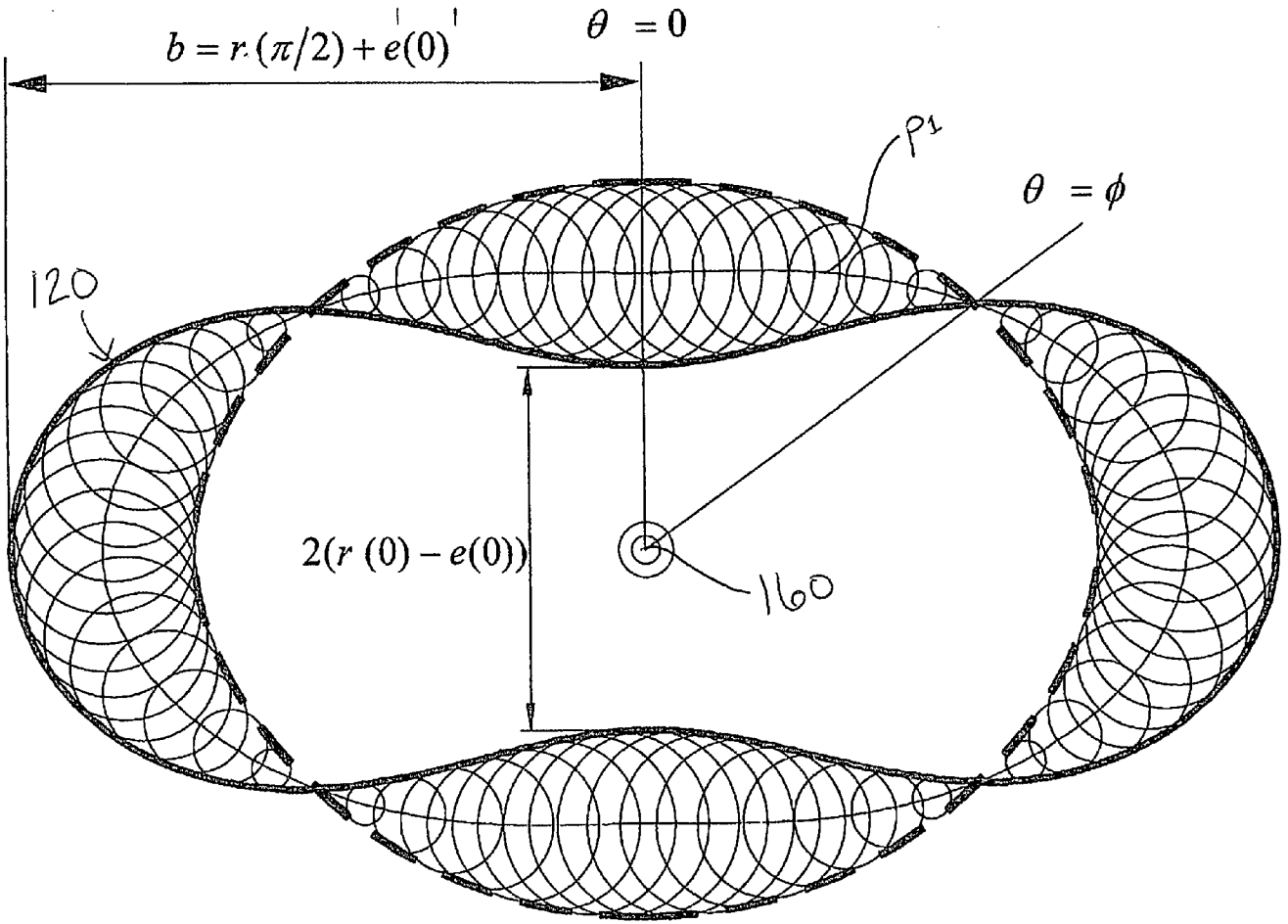
FIG. 2C is a detailed plan view of a rotor profile shown in FIG. 2B, showing its corresponding non-circular pitch profile and deviation function.
Figure 3A:
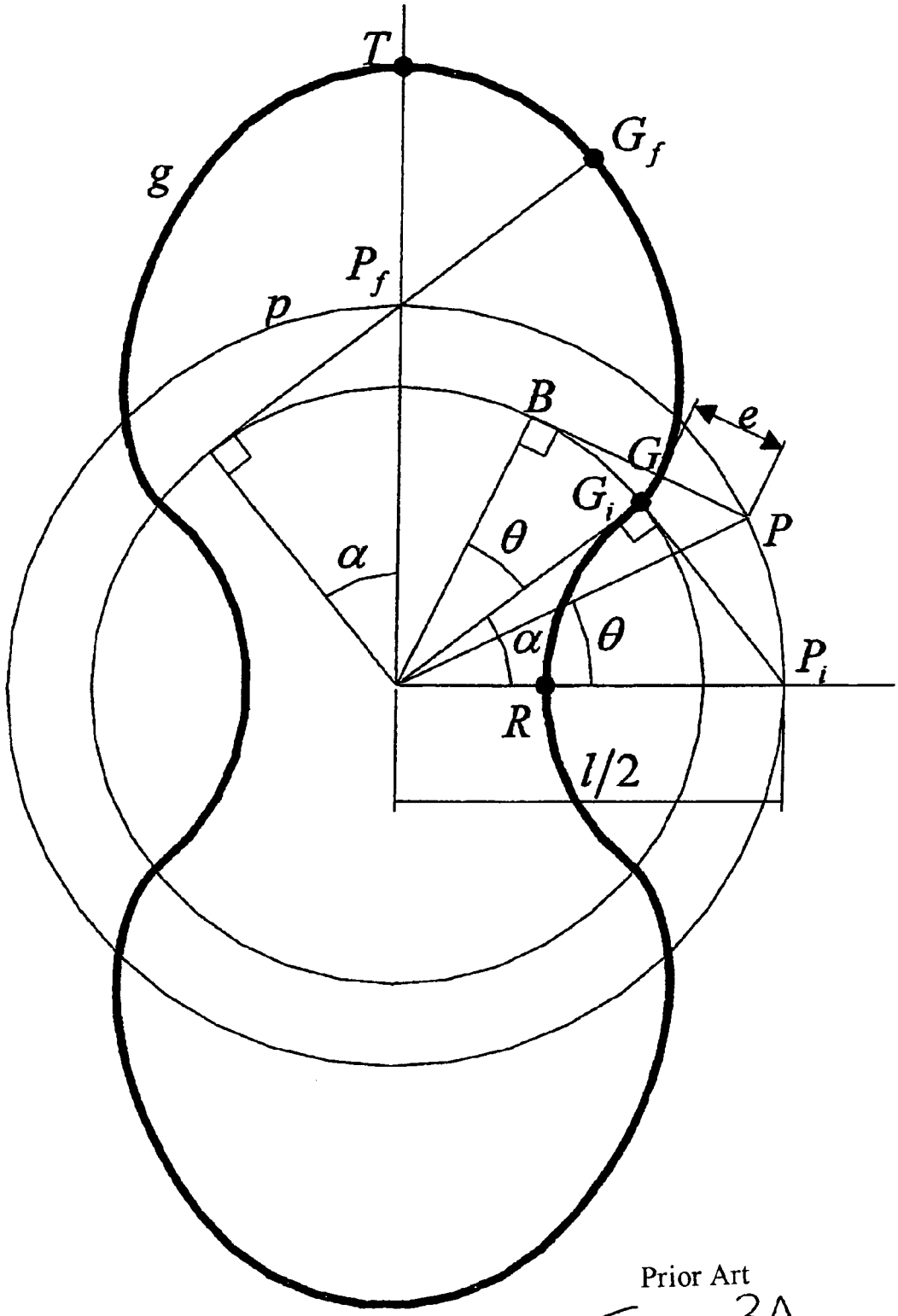
Prior Art Figure 3A
FIG. 3A is a plan view of a conventional involute lobe pump rotor profile.
Figure 3B:
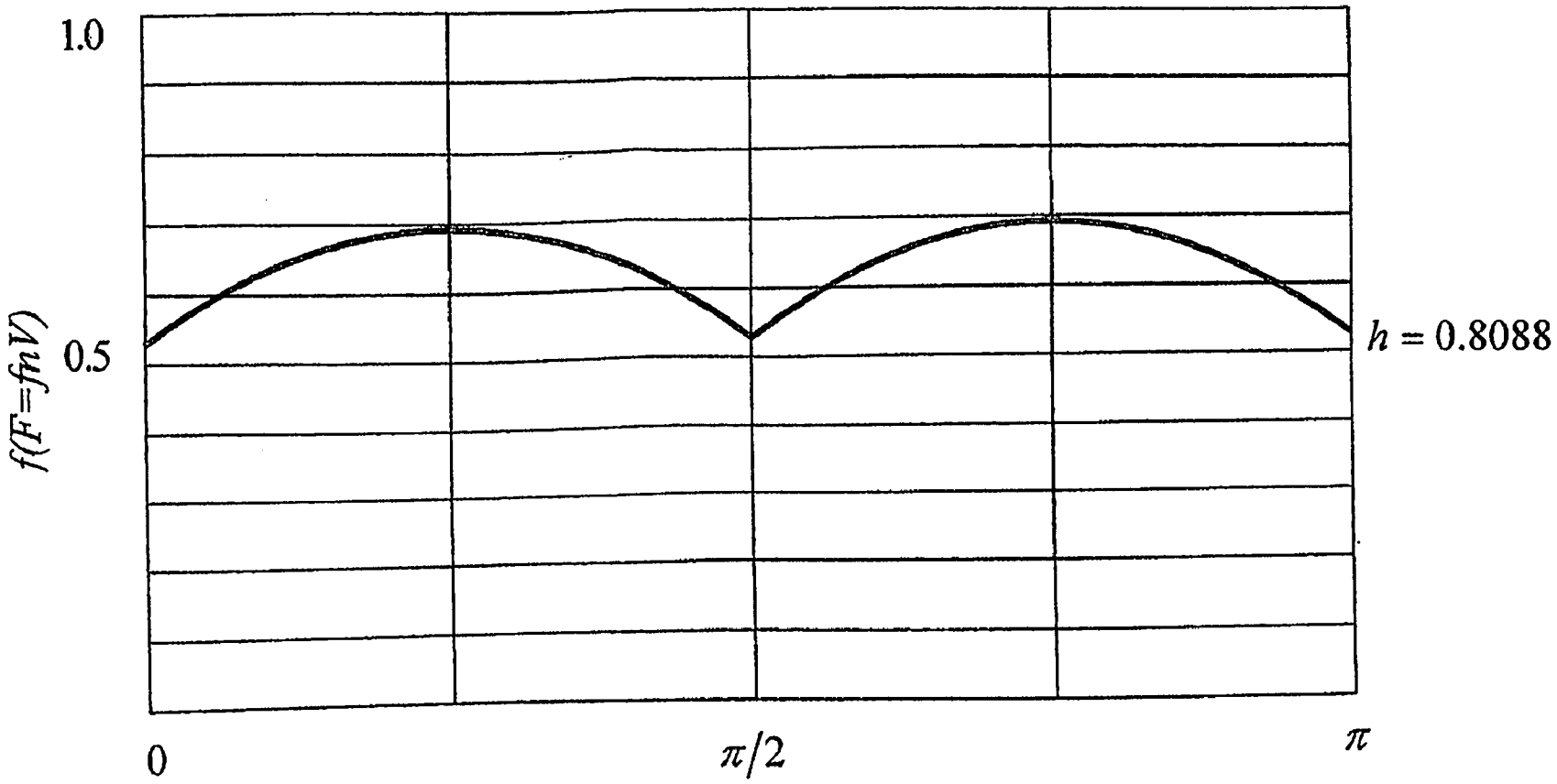
FIG. 3B is a diagram of the resultant flow rate of a lobe pump having rotors shaped as shown in FIG. 3A.
Figure 4:
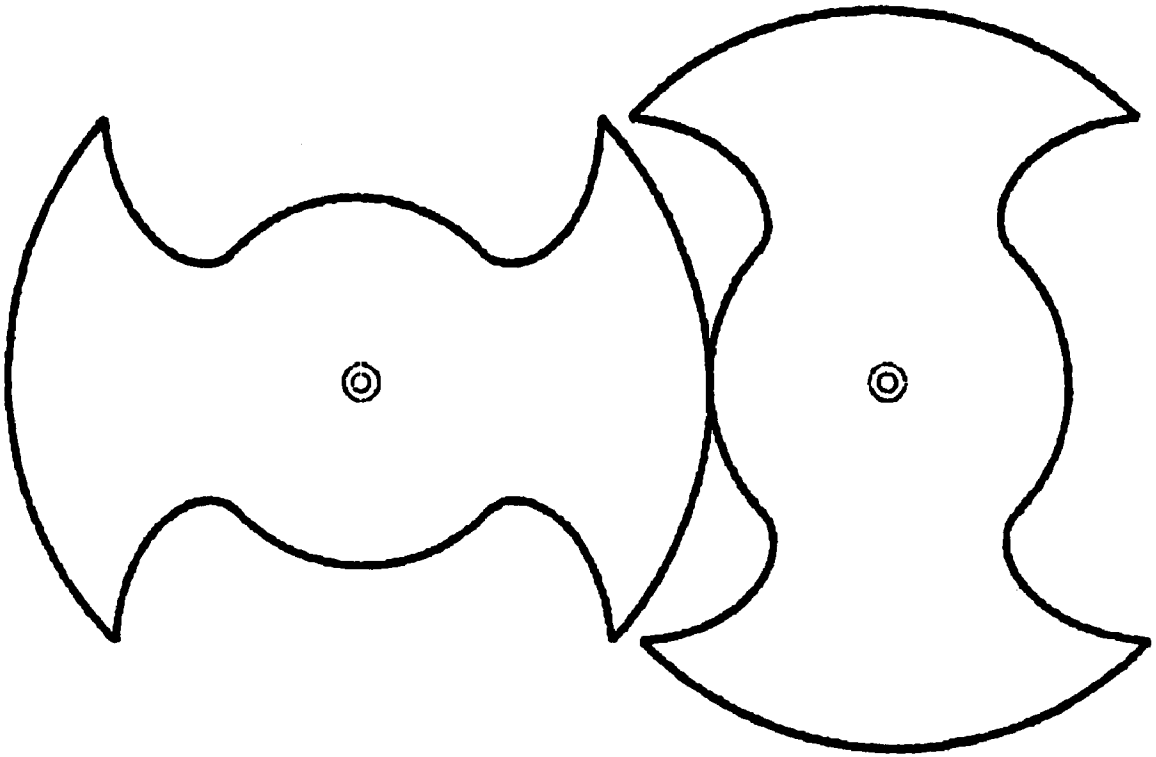
Prior Art Figure 4
FIG. 4 is a plan view of a pair of conventional, epitrochoidal lobe pump rotor profiles.

Although this embodiment is based on generation of a rotor profile that corresponds to a circular pitch profile p (FIG. 3A), rotor profiles may alternatively be generated that correspond to non-circular pitch profiles, such as is shown in FIGS. 2B-2C.

One example of a generation of F(θ) from a function type with unknown variables will now be described. In this example, the function type is selected to be sinusoidal, which can be represented by $F(\theta)=A_0+A\cos\alpha\theta$, where $A_0$, A, and α are unknown constants and θ is the angle of rotation of the rotor.

In this case, a normalized function of F(θ) becomes $$f(\theta) = \frac{\pi}{\pi h^2 + 2h}\left(\left(h+\frac{3}{2}\right)\left(h-\frac{1}{2}\right) - \left(h-\frac{1}{2}\right)^2\cos 2N\theta\right),$$

$$\text{where } h = \frac{F_{\max}}{F_{\min}} - .5.$$

A deviation function can then be determined to be $e(\theta)=l(h-0.5)\cos N\theta$. This deviation function can then be inserted into the equation $$F(\theta) = \frac{\dot{\theta}\cdot l(b^2 - r(l-r) - e(\theta)^2)w}{2(l-r)}$$

as taught in the prior art and simplified for a circular pitch profile, where $$r = \frac{l}{2}.$$

Further, the function F(θ) can be put in terms of l by substituting the thickness w according to the relation $$wl^2 = \frac{NTF_{\min}^2}{\pi(F_{\max}-F_{\min})}.$$

F(θ) is then calculated to be $F(\theta)=F_{max}-(F_{max}-F_{min})\cos^2 N\theta$, which is in the form $F(\theta)=A_0+A\cos\alpha\theta$ through the relation, $$\cos^2 N\theta = \frac{1}{2}(\cos 2N\theta + 1).$$

Figure 7A:
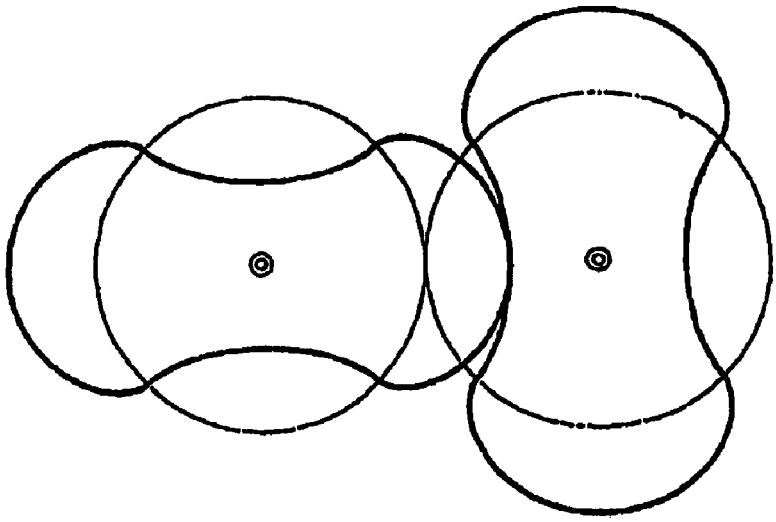
FIG. 7A is a plan view of a pair of rotor profiles designed to produce a sinusoidal flow rate, according to one embodiment of the invention.
Figure 7B:
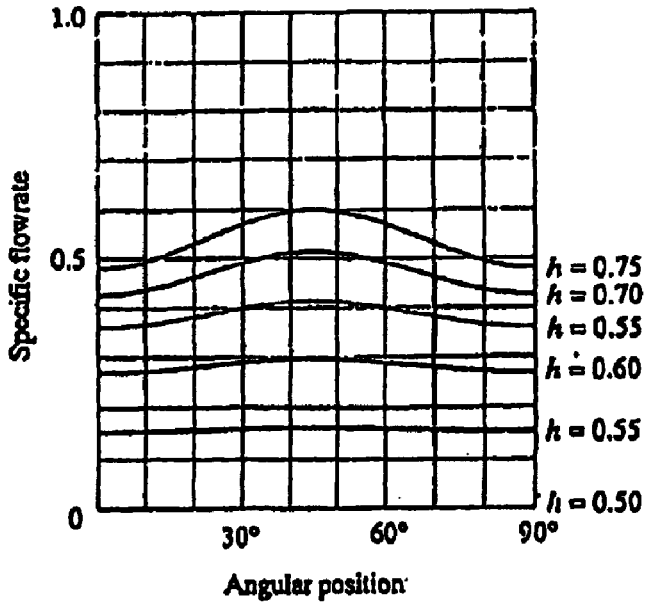
FIG. 7B is a diagram of the resultant flow rate of a lobe pump having the rotor profiles shown in FIG. 7A.
Figure 8A:
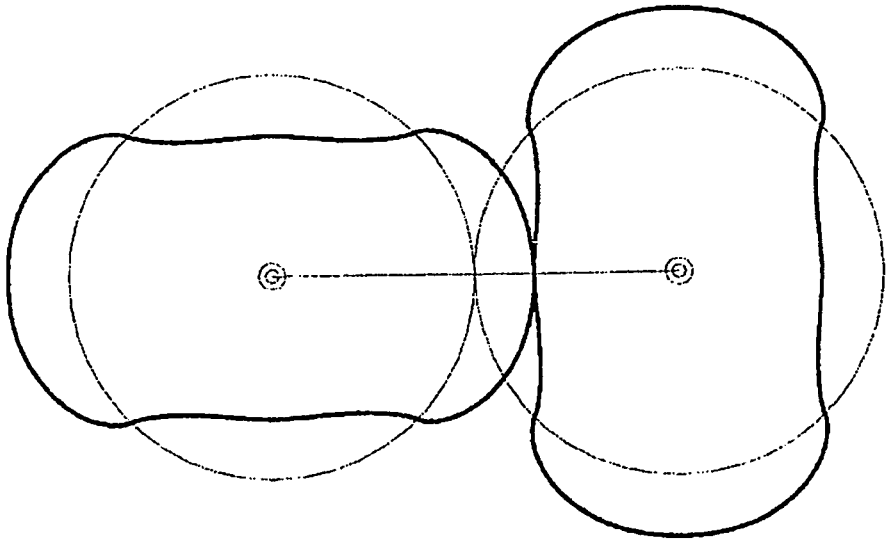
FIG. 8A is a plan view of a pair of rotor profiles designed to produce a fourth order polynomial flow rate, according to another embodiment of the invention.
Figure 8B:
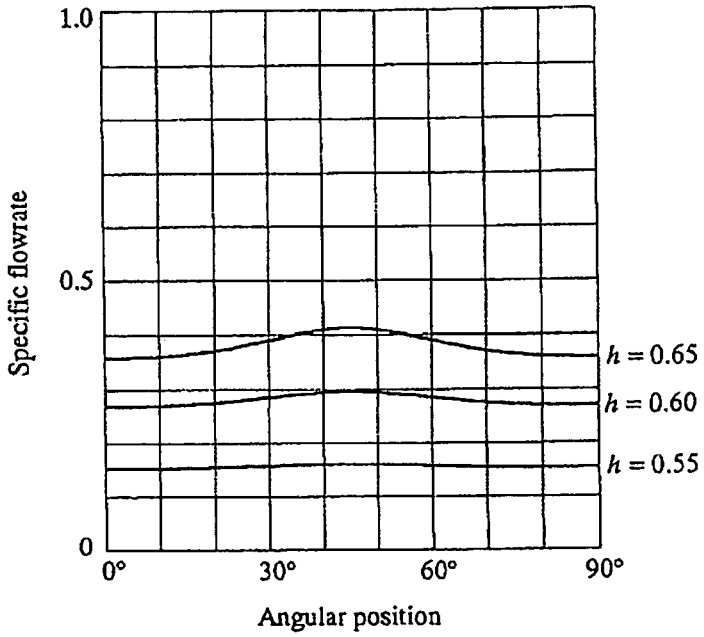
FIG. 8B is a diagram of the resultant flow rate of a lobe pump having the rotor profiles shown in FIG. 8A.
Figure 9A:
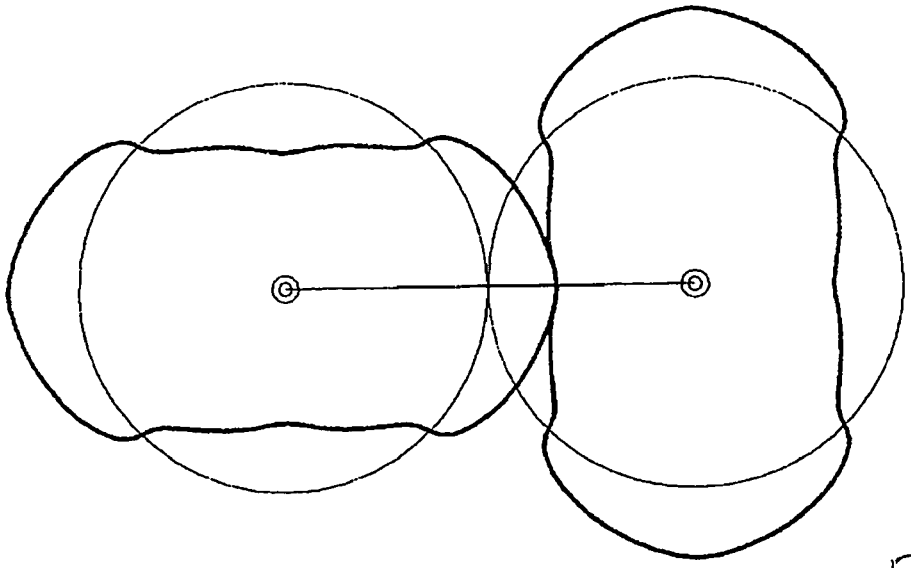
FIG. 9A is a plan view of a pair of rotor profiles designed to produce a linear flow rate, according to another embodiment of the invention.
Figure 9B:
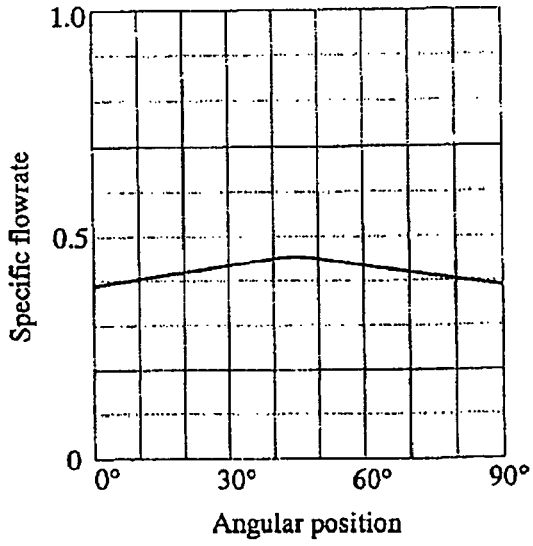
FIG. 9B is a diagram of the resultant flow rate of a lobe pump having the rotor profiles shown in FIG. 9A.
Figure 10:
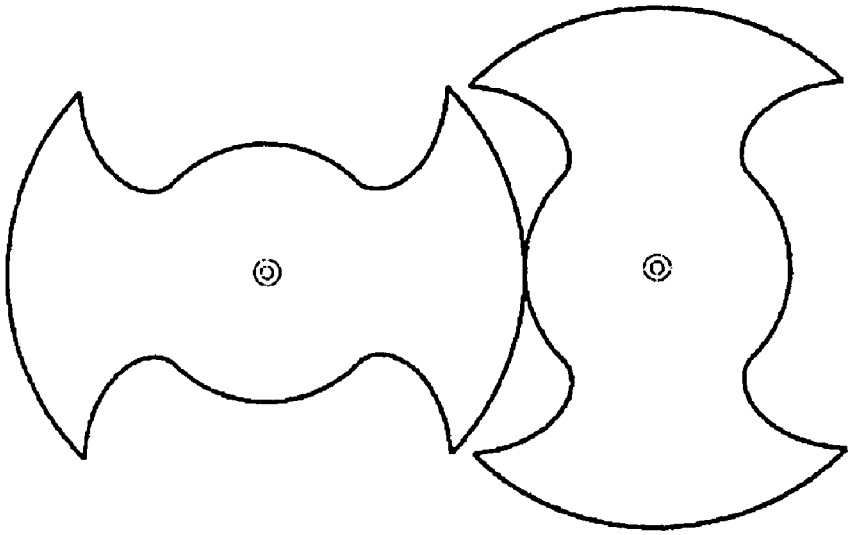
FIG. 10 is a plan view of a pair of rotor profiles designed to produce a constant flow rate.

If N=2 lobes are selected, the resultant lobe profiles for the desired sinusoidal flow rate type are shown in FIG. 7A. The resultant flow rate in terms of angular position of the rotor is shown in FIG. 7B. As shown, the flow rate varies in amplitude according to the ratio of $F_{max}$ to $F_{min}$, or h+0.5.

Although a sinusoidal function type is discussed above, the function type can alternatively be selected as polynomial, linear, constant, parabolic, and any other continuous functions, and represented as a corresponding function F(θ). Examples of polynomial, linear, and constant flow profiles and their corresponding flow rates in terms of angular rotation of the rotor are shown in FIGS. 8A-B, 9A-B, and 10, respectively.

With reference to FIG. 11, a second embodiment of the method is described. In this embodiment, a desired flow rate is expressed as a function of time, F(t). A number of lobes N and the distance between the axes of rotation l are selected as above.

In this embodiment, $F_{max}$, $F_{min}$, and period T are calculated through known methods from F(t), and a half lobe profile g is designed according to the following two equations:

$$g_x = \frac{l}{2}\cos\frac{\pi\cdot t}{TN} + \frac{l}{F_{\min}}\sqrt{(F_{\max}-F_{\min})(F_{\max}-F(t))}\cos\left(\frac{\pi\cdot t}{TN} + \sin^{-1}\left(\frac{-TNF'(t)\sqrt{F_{\max}-F_{\min}}}{\pi\cdot F_{\min}\sqrt{F_{\max}-F(t)}}\right) + \pi\right) \quad 1)$$

$$g_y = \frac{l}{2}\sin\frac{\pi\cdot t}{TN} + \frac{l}{F_{\min}}\sqrt{(F_{\max}-F_{\min})(F_{\max}-F(t))}\sin\left(\frac{\pi\cdot t}{TN} + \sin^{-1}\left(\frac{-TNF'(t)\sqrt{F_{\max}-F_{\min}}}{\pi\cdot F_{\min}\sqrt{F_{\max}-F(t)}}\right) + \pi\right)$$

$$\text{for } 0 \le t \le \frac{T}{2}, \text{ where } F'(t) = \frac{dF(t)}{dt}; \text{ and}$$

$$g_x = \frac{l}{2}\cos\frac{\pi\cdot t}{TN} + \frac{l}{F_{\min}}\sqrt{(F_{\max}-F_{\min})(F_{\max}-F(t))}\cos\left(\frac{\pi\cdot t}{TN} - \sin^{-1}\left(\frac{-TNF'(t)\sqrt{F_{\max}-F_{\min}}}{\pi\cdot F_{\min}\sqrt{F_{\max}-F(t)}}\right)\right) \quad 2)$$

$$g_y = \frac{l}{2}\sin\frac{\pi\cdot t}{TN} + \frac{l}{F_{\min}}\sqrt{(F_{\max}-F_{\min})(F_{\max}-F(t))}\sin\left(\frac{\pi\cdot t}{TN} - \sin^{-1}\left(\frac{-TNF'(t)\sqrt{F_{\max}-F_{\min}}}{\pi\cdot F_{\min}\sqrt{F_{\max}-F(t)}}\right)\right)$$

$$\text{for } \frac{T}{2} \le t \le T.$$

The profile of the other half of the lobe, the remaining lobes, and the rotor thickness are then designed as described above.

Another embodiment of the method is shown in FIG. 12. In this embodiment, a desired flow rate is expressed as a function of the angle of rotor rotation, F(θ). The number of lobes N and distance between the axes of rotation l, is selected as above. $F_{max}$, $F_{min}$, and period T are calculated through known methods from F(θ), and a half lobe profile g is designed according to the following two equations:

$$g_x = \frac{l}{2}\cos\theta + \frac{l}{F_{\min}}\sqrt{(F_{\max}-F_{\min})(F_{\max}-F(\theta))}\cos\left(\theta+\sin^{-1}\left(\frac{-F'(\theta)\sqrt{F_{\max}-F_{\min}}}{F_{\min}\sqrt{F_{\max}-F(\theta)}}\right)+\pi\right) \quad 1)$$

$$g_y = \frac{l}{2}\sin\theta + \frac{l}{F_{\min}}\sqrt{(F_{\max}-F_{\min})(F_{\max}-F(\theta))}\sin\left(\theta+\sin^{-1}\left(\frac{-F'(\theta)\sqrt{F_{\max}-F_{\min}}}{F_{\min}\sqrt{F_{\max}-F(\theta)}}\right)+\pi\right)$$

for $0 \le \theta \le \frac{\pi}{2N}$, where $F'(\theta) = \frac{dF(\theta)}{d\theta}$; and $$g_x = \frac{l}{2}\cos\theta + \frac{l}{F_{\min}}\sqrt{(F_{\max}-F_{\min})(F_{\max}-F(\theta))}\cos\left(\theta-\sin^{-1}\left(\frac{-F'(\theta)\sqrt{F_{\max}-F_{\min}}}{F_{\min}\sqrt{F_{\max}-F(\theta)}}\right)\right) \quad 2)$$

$$g_y = \frac{l}{2}\sin\theta + \frac{l}{F_{\min}}\sqrt{(F_{\max}-F_{\min})(F_{\max}-F(\theta))}\sin\left(\theta-\sin^{-1}\left(\frac{-F'(\theta)\sqrt{F_{\max}-F_{\min}}}{F_{\min}\sqrt{F_{\max}-F(\theta)}}\right)\right)$$

for $\frac{\pi}{2N} \le \theta \le \frac{\pi}{N}$.

The profile of the other half of the lobe, the remaining lobes, and the rotor thickness are then designed as described above.

In one embodiment, after the rotor profiles are determined, two identical rotors are formed through conventional methods with a thickness w. The rotors are then placed in a lobe pump on parallel axes of rotation at a distance l from each other. The rotors are then driven by conventional means at a frequency of n=½ NT, where N is the number of lobes and T is the period.

The invention has been described and illustrated by exemplary and preferred embodiments, but is not limited thereto. Persons skilled in the art will appreciate that a number of modifications can be made without departing from the scope of the invention, which is limited only by the appended claims and equivalents thereof.

What is claimed is:

1. A method of manufacturing a rotor to be used in a dual-rotor lobe pump system for pumping a material at a desired periodic rate, the method comprising:

selecting a desired periodic flow rate for said material;

selecting a number of lobes for the rotor;

selecting one of a thickness of the rotor or a spacing between the axis of rotation of the rotor and the axis of rotation of an adjacent rotor in said lobe pump; and determining a profile for the rotor based on the desired periodic flow rate, the number of lobes, and the one of the thickness or the spacing, such that when the rotor is operated within said dual-rotor lobe pump system, said material can be pumped at substantially the desired periodic flow rate, wherein the selecting the desired periodic flow rate comprises selecting a flow rate function F(t) in terms of time t, and wherein the determining comprises:

determining a maximum flow rate $F_{max}$, a minimum flow rate $F_{min}$, and a period T from the desired periodic flow rate;

designing the other of the thickness w or the spacing l of the rotor to satisfy the following formula:

$$wl^2 = \frac{NTF_{\min}^2}{\pi(F_{\max}-F_{\min})},$$

where N is the number of lobes on the rotor;

designing a profile, $g_x$ and $g_y$, of a first half of one lobe of the rotor to satisfy the following formulas:

$$g_x = \frac{l}{2}\cos\frac{\pi\cdot t}{TN} + \frac{l}{F_{\min}}\sqrt{(F_{\max}-F_{\min})(F_{\max}-F(t))}\cos\left(\frac{\pi\cdot t}{TN}+\sin^{-1}\left(\frac{-TNF'(t)\sqrt{F_{\max}-F_{\min}}}{\pi\cdot F_{\min}\sqrt{F_{\max}-F(t)}}\right)+\pi\right)$$

$$g_y = \frac{l}{2}\sin\frac{\pi\cdot t}{TN} + \frac{l}{F_{\min}}\sqrt{(F_{\max}-F_{\min})(F_{\max}-F(t))}\sin\left(\frac{\pi\cdot t}{TN}+\sin^{-1}\left(\frac{-TNF'(t)\sqrt{F_{\max}-F_{\min}}}{\pi\cdot F_{\min}\sqrt{F_{\max}-F(t)}}\right)+\pi\right)$$

for $0 \le t \le \frac{T}{2}$, where $F'(t) = \frac{dF(t)}{dt}$; and $$g_x = \frac{l}{2}\cos\frac{\pi\cdot t}{TN} + \frac{l}{F_{\min}}\sqrt{(F_{\max}-F_{\min})(F_{\max}-F(t))}\cos\left(\frac{\pi\cdot t}{TN}-\sin^{-1}\left(\frac{-TNF'(t)\sqrt{F_{\max}-F_{\min}}}{\pi\cdot F_{\min}\sqrt{F_{\max}-F(t)}}\right)\right)$$

$$g_y = \frac{l}{2}\sin\frac{\pi\cdot t}{TN} + \frac{l}{F_{\min}}\sqrt{(F_{\max}-F_{\min})(F_{\max}-F(t))}\sin\left(\frac{\pi\cdot t}{TN}-\sin^{-1}\left(\frac{-TNF'(t)\sqrt{F_{\max}-F_{\min}}}{\pi\cdot F_{\min}\sqrt{F_{\max}-F(t)}}\right)\right)$$

or $\frac{T}{2} \le t \le T$;

designing a profile of the second half of the one lobe of the rotor, such that said one lobe is symmetrical; and designing a profile of any remaining lobe or lobes of the rotor such that the remaining lobe or lobes have the same profile as said one lobe and all of the lobes are evenly spaced from each other.

2. The method of claim 1, further comprising forming the rotor having the profile, the number of lobes, and the thickness.

3. The method of claim 2, further comprising forming a second rotor having the profile, the number of lobes, and the thickness.

4. The method of claim 1, wherein the function type is a continuous function.

5. The method of claim 4, wherein the continuous function is selected from the group consisting of polynomial, sinusoidal, linear, parabolic, and constant.

6. A method of manufacturing a rotor to be used in a dual-rotor lobe pump system for pumping a material at a desired periodic rate, the method comprising:

selecting a desired periodic flow rate for said material;

selecting a number of lobes for the rotor;

selecting one of a thickness of the rotor or a spacing between the axis of rotation of the rotor and the axis of rotation of an adjacent rotor in said lobe pump; and determining a profile for the rotor based on the desired periodic flow rate, the number of lobes, and the one of the thickness or the spacing, such that when the rotor is operated within said dual-rotor lobe pump system, said material can be pumped at substantially the desired periodic flow rate, wherein the selecting the desired periodic flow rate comprises selecting a flow rate function in terms of angular rotation of the rotor F(θ), and wherein the determining comprises:

determining a maximum flow rate $F_{max}$, a minimum flow rate $F_{min}$, and a period T from the desired periodic flow rate;

designing the other of the thickness w or spacing l of the rotor to satisfy following formula:

$$wl^2 = \frac{NTF_{\min}^2}{\pi(F_{\max} - F_{\min})},$$

where N is the number of lobes;

designing a profile, $g_x$ and $g_y$, of a first half of one lobe of the rotor to satisfy the following formulas:

$$g_x = \frac{l}{2}\cos\theta + \frac{l}{F_{\min}}\sqrt{(F_{\max} - F_{\min})(F_{\max} - F(\theta))}\cos\left(\theta + \sin^{-1}\left(\frac{-F'(\theta)\sqrt{F_{\max} - F_{\min}}}{F_{\min}\sqrt{F_{\max} - F(\theta)}}\right) + \pi\right)$$

$$g_y = \frac{l}{2}\sin\theta + \frac{l}{F_{\min}}\sqrt{(F_{\max} - F_{\min})(F_{\max} - F(\theta))}\sin\left(\theta + \sin^{-1}\left(\frac{-F'(\theta)\sqrt{F_{\max} - F_{\min}}}{F_{\min}\sqrt{F_{\max} - F(\theta)}}\right) + \pi\right)$$

$$\text{for } 0 \le \theta \le \frac{\pi}{2N}, \text{ where } F'(\theta) = \frac{dF(\theta)}{d\theta}; \text{ and}$$

$$g_x = \frac{l}{2}\cos\theta + \frac{l}{F_{\min}}\sqrt{(F_{\max} - F_{\min})(F_{\max} - F(\theta))}\cos\left(\theta - \sin^{-1}\left(\frac{-F'(\theta)\sqrt{F_{\max} - F_{\min}}}{F_{\min}\sqrt{F_{\max} - F(\theta)}}\right)\right)$$

$$g_y = \frac{l}{2}\sin\theta + \frac{l}{F_{\min}}\sqrt{(F_{\max} - F_{\min})(F_{\max} - F(\theta))}\sin\left(\theta - \sin^{-1}\left(\frac{-F'(\theta)\sqrt{F_{\max} - F_{\min}}}{F_{\min}\sqrt{F_{\max} - F(\theta)}}\right)\right)$$

$$\text{for } \frac{\pi}{2N} \le \theta \le \frac{\pi}{N};$$

designing a profile of the second half of the one lobe of the rotor, such that the one lobe is symmetrical; and designing a profile of any remaining lobe or lobes of the rotor such that the remaining lobe or lobes have the same profile as the one lobe and all of the lobes are evenly spaced from each other.

7. The method of claim 6, further comprising: forming the rotor having the profile, the number of lobes, and the thickness.

8. The method of claim 7, further comprising forming a second rotor having the profile, the number of lobes, and the thickness.

9. The method of claim 6, wherein the function type is a continuous function.

10. The method of claim 9, wherein the continuous function is selected from the group consisting of polynomial, sinusoidal, linear, parabolic, and constant.

11. A method of manufacturing a rotor to be used in a dual-rotor lobe pump system for pumping a material at a desired periodic rate, the method comprising:

selecting a desired periodic flow rate for said material;

selecting a number of lobes for the rotor;

selecting one of a thickness of the rotor or a spacing between the axis of rotation of the rotor and the axis of rotation of an adjacent rotor in said lobe pump; and determining a profile for the rotor based on the desired periodic flow rate, the number of lobes, and the one of the thickness or the spacing, such that when the rotor is operated within said dual-rotor lobe pump system, said material can be pumped at substantially the desired periodic flow rate, wherein the selecting the desired periodic flow rate comprises:

selecting a maximum flow rate $F_{max}$ and a minimum flow rate $F_{min}$;

selecting a function type; and selecting a period T; and wherein the determining comprises:

designing the other of the thickness w or spacing l of the rotor to satisfy following formula:

$$wl^2 = \frac{NTF_{\min}^2}{\pi(F_{\max} - F_{\min})},$$

where N is the number of lobes;

selecting a flow rate function F(θ) having the selected maximum flow rate, minimum flow rate, period, and function type, where θ is an angle of rotation of the rotor;

designing a profile, $g_x$ and $g_y$, of a first half of one lobe of the rotor to satisfy the following formulas:

$$g_{1x} = \frac{l}{2}\cos\theta + \frac{l}{F_{\min}}\sqrt{(F_{\max} - F_{\min})(F_{\max} - F(\theta))}\cos\left(\theta + \sin^{-1}\left(\frac{-F'(\theta)\sqrt{F_{\max} - F_{\min}}}{F_{\min}\sqrt{F_{\max} - F(\theta)}}\right) + \pi\right)$$

$$g_{1y} = \frac{l}{2}\sin\theta + \frac{l}{F_{\min}}\sqrt{(F_{\max} - F_{\min})(F_{\max} - F(\theta))}\sin\left(\theta + \sin^{-1}\left(\frac{-F'(\theta)\sqrt{F_{\max} - F_{\min}}}{F_{\min}\sqrt{F_{\max} - F(\theta)}}\right) + \pi\right)$$

$$\text{for } 0 \le \theta \le \frac{\pi}{2N}, \text{ where } F'(\theta) = \frac{dF(\theta)}{d\theta}; \text{ and}$$

$$g_{1x} = \frac{l}{2}\cos\theta + \frac{l}{F_{\min}}\sqrt{(F_{\max} - F_{\min})(F_{\max} - F(\theta))}\cos\left(\theta - \sin^{-1}\left(\frac{-F'(\theta)\sqrt{F_{\max} - F_{\min}}}{F_{\min}\sqrt{F_{\max} - F(\theta)}}\right)\right)$$

$$g_{1y} = \frac{l}{2}\sin\theta + \frac{l}{F_{\min}}\sqrt{(F_{\max} - F_{\min})(F_{\max} - F(\theta))}$$

-continued $$\sin\left(\theta - \sin^{-1}\left(\frac{-F'(\theta)\sqrt{F_{max} - F_{min}}}{F_{min}\sqrt{F_{max} - F(\theta)}}\right)\right)$$

for $\frac{\pi}{2N} \leq \theta \leq \frac{\pi}{N}$;

designing a profile of the second half of the one lobe of the rotor, such that the one lobe is symmetrical; and designing a profile of any remaining lobe or lobes of the rotor such that the remaining lobe or lobes have the same profile as the one lobe and all of the lobes are evenly spaced from each other.

12. The method of claim 11, wherein the function type is a continuous function.

13. The method of claim 12, wherein the continuous function is selected from the group consisting of polynomial, sinusoidal, linear, parabolic, and constant.

14. The method of claim 11, further comprising: forming the rotor having the profile, the number of lobes, and the thickness.

15. The method of claim 14, further comprising forming a second rotor having the profile, the number of lobes, and the thickness.

* * * * *